US006744340B2

(12) United States Patent
Van Zeeland et al.

(10) Patent No.: US 6,744,340 B2
(45) Date of Patent: Jun. 1, 2004

(54) SWITCH WITH MAGNETICALLY COUPLED ROCKER ARMATURE

(75) Inventors: Anthony J. Van Zeeland, Mesa, AZ (US); Scott Allen Hill, Phoenix, AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 290 days.

(21) Appl. No.: 09/974,359

(22) Filed: Oct. 10, 2001

(65) Prior Publication Data

US 2003/0067371 A1 Apr. 10, 2003

(51) Int. Cl.[7] ..... H01H 9/00

(52) U.S. Cl. ..... 335/205; 200/518; 200/327; 200/404

(58) Field of Search ..... 335/205–207; 200/314, 318–327, 404, 512, 517

(56) References Cited

U.S. PATENT DOCUMENTS 4,296,394 A * 10/1981 Ragheb ..... 335/207
5,523,730 A * 6/1996 Van Zeeland ..... 335/205
5,666,096 A * 9/1997 Van Zeeland ..... 335/4
5,990,772 A * 11/1999 Van Zeeland ..... 335/207
6,369,692 B1 * 4/2002 Van Zeeland ..... 338/200
6,392,515 B1 * 5/2002 Van Zeeland et al. ..... 335/205
6,400,246 B1 * 6/2002 Hill et al. ..... 335/205
6,542,058 B2 * 4/2003 Van Zeeland ..... 335/205
2003/0160669 A1 * 8/2003 Trandafir ..... 335/78

* cited by examiner

*Primary Examiner*—Lincoln Donovan
*Assistant Examiner*—Bernard Rojas
(74) *Attorney, Agent, or Firm*—Scott A. Hill

(57) ABSTRACT

An electrical switch, such as a two-position rocker or a momentary rocker switch, has an electrically conductive armature made of magnetic material that includes at least two faces extending from a common vertex. The armature is mounted to pivot about its common vertex to bring at least one of the armature faces into and out of electrical shorting relationship with electrical conductors of the switch that, preferably, are formed directly on a nonconductive sheet magnet coupler layer. The sheet magnet coupler layer magnetically attracts and holds the rocker armature in a switch position until a user applied actuating force is applied to a face of the armature such that the armature pivots to another switch position and, preferably, the switch is provided with an armature illumination system.

28 Claims, 5 Drawing Sheets

SWITCH WITH MAGNETICALLY COUPLED ROCKER ARMATURE

BACKGROUND OF THE INVENTION

Magnetic switches with magnetically coupled armatures provide a compact, reliable and durable switching function. These switches offer a very slim profile, low weight, economical assembly, and are used in an increasing number of applications in a variety of environments. They combine the tactile feel of a bulky mechanical switch with the compactness of a conventional membrane switch. Magnetically coupled switches of this general type are shown and described in U.S. Pat. Nos. 5,523,730, 5,666,096 and 5,867,082, the disclosures of which are hereby incorporated herein by reference. While switches with magnetically coupled armatures already have many applications, it is advantageous to expand the applications of such switches even further, and the present invention relates to a magnetic rocker switch, suitable for a large variety of applications, with a unique rocker armature that is magnetically coupled to a sheet magnet coupler layer. The unique rocker armature may also be held in one or more actuated positions by a sheet magnet coupler layer or layers (magnetically held in each actuated position by being coupled to a sheet magnet coupler layer) after being actuated into the position by an actuating force applied to the rocker armature by the user.

There are numerous uses and needs for magnetic pushbutton switches of the type shown in U.S. Pat. Nos. 5,523,730, 5,666,096 and 5,867,082. These magnetic pushbutton switches are characteristically designed to be momentary switches that momentarily affect the logic of external electronics connected to the switches. Once the applied actuating force of a user is released from the pushbutton switch armature of such magnetic switches, the switch armature does not remain in the actuated position, but is returned to its initial position by the magnetic attraction of a coupler magnet. In being returned to its initial position, with the armature held by the coupler magnet, there is typically a return of the logic of the external electronics connected to the switch to its initial state. Rocker switches do not have this limitation. However, most rocker switches, like the rocker switch of U.S. Pat. No. 5,666,096, with its relatively thick permanent magnets, are either bulky or lack the tactile feel of a magnetically coupled pushbutton switch.

As mentioned above, the present invention relates to a magnetic rocker switch and, more specifically, to a magnetic rocker switch with a unique rocker armature that is magnetically coupled to a sheet magnet coupler layer or magnetically held in an actuated position by being coupled to a sheet magnet coupler layer after being actuated into the position by an actuating force applied to the armature by a user. Furthermore, the rocker switch of the present invention is compact; provides a tactile feel; and, in preferred embodiments, includes a unique armature illumination system and/or sheet magnet coupler layer, such as a sheet magnet coupler layer with electrical conductors formed directly on the sheet magnet coupler layer.

SUMMARY OF THE INVENTION

The magnetic rocker switch of the present invention includes a unique rocker armature made of an electrically conductive magnetic material and one or more sheet magnet coupler layers for actuating the rocker armature into and/or out of shorting relationship with electrical conductors of the switch and/or holding the rocker armature in and/or out of shorting relationship with electrical conductors of the switch. As used herein, the term "switch" includes devices for closing, opening, or changing the connections in an electrical circuit; the term "magnetic material" means a magnet or a material that is affected by a magnet; and the term "electrical conductors" includes electrodes, resistor elements, and spaced electrical contacts or pads. Electrical leads connect the electrical conductors of the switch to electronics that are external to the switch. The electrical conductors are arranged within the switch so that the electrically conductive magnetic armature of the switch is movable into and out of shorting relationship with the electrical conductors and for some switches, movable relative to one electrical conductor while in contact with another electrical conductor, e.g. a resistor element of a potentiometer, to change the resistance of a circuit or otherwise change the circuit logic for a circuit incorporating the switch.

The unique rocker armature of the magnetic rocker switch of the present invention, which as mentioned above is electrically conductive and made of a magnetic material, has at least two faces joined by a common vertex. The magnetic attraction between a sheet magnet coupler layer of the switch and the armature holds a first face of the armature in engagement with the sheet magnet coupler layer or a layer overlaying the sheet magnet coupler layer (e.g., a layer such as but not limited to an electrically nonconductive layer with electrical conductors thereon). An actuating force applied by a user to another face of the armature causes corresponding movement of the armature's first face to a position into or out of electrical shorting relationship with electrical conductors of the switch and, as the actuating force is applied by a user, the user feels a crisp, tactile snap as the first face of the armature breaks away from the sheet magnet coupler layer. In certain embodiments of the invention, when the actuating force exerted by the user is released, the rocker armature is returned to its initial position and held there by the magnetic attraction of the sheet magnet coupler layer. In these embodiments of the switch, a different face of the rocker armature may be brought into contact with a surface of a nonmagnetic layer that may or may not have electrical conductors thereon. In other embodiments of the invention, when an actuating force is applied to the armature by a user, the movement of the armature places a different face of the armature in contact with another surface of the sheet magnet coupler layer or a layer overlaying the sheet magnet coupler layer (these layers may or may not have electrical conductors thereon) and after the actuating force is released, the armature is held in that new position by the magnetic attraction of the other surface of the sheet magnet coupler layer; or the movement of the armature places a different face of the armature in contact with a second sheet magnet coupler layer that is located in a plane other than the plane containing the first sheet magnet coupler layer or a layer overlaying the second sheet magnet coupler layer (these layers may or may not have electrical conductors thereon) and after the actuating force is released, the armature is held in that new position by the magnetic attraction of the second sheet magnet coupler layer. In either of the switches discussed in the previous sentence, the movement of the armature into the new position may bring another face of the rocker armature into contact with a surface of a nonmagnetic layer that may or may not have electrical conductors thereon.

In a preferred embodiment of the magnetic rocker switch of the present invention, the one or more sheet magnet coupler layers of the switch are essentially electrically nonconductive and the electrical conductors may be formed directly on a surface of each of the one or more sheet magnet coupler layers included in the switch. In another preferred embodiment of the magnetic rocker switch of the present invention, one or more faces of the armature are selectively illuminated to indicate a certain switch condition.

DETAILED DESCRIPTION OF THE INVENTION

Figure 1:
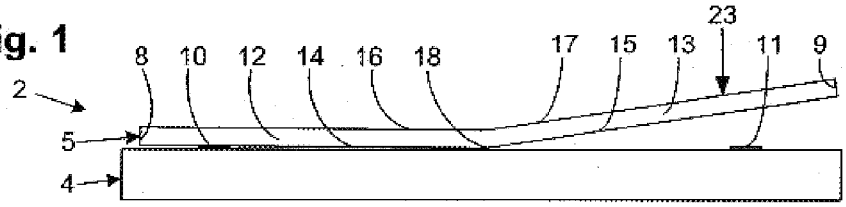
FIG. 1 is a side elevation view of a two-position magnetic rocker switch having a sheet metal rocker armature according to the present invention.

FIG. 1 illustrates a magnetic two-position rocker switch of the present invention. The rocker switch, shown generally at 2, includes a sheet magnet coupler layer 4 and a rocker armature 5. The sheet magnet coupler layer has first and second surfaces. First and second sets of switch electrical conductors 11 and 10 are partially shown on the first surface of the sheet magnet coupler layer 4. The sheet magnet coupler layer is electrically nonconductive or essentially electrically nonconductive, so the sets of switch electrical conductors 10 and 11 may be formed, e.g. by screen printing or etching, directly on the first surface of the sheet magnet coupler layer. Alternatively, the sets of switch electrical conductors 10 and 11 may be formed, e.g. by screen printing or etching, on an electrically nonconductive carrier layer, e.g. a polyester membrane layer, not shown, adhesively bonded or otherwise affixed to the first surface of the sheet magnet coupler layer 4. Electrical leads, not shown, connect the sets of switch electrical conductors 10 and 11 to electronics external of the switch 2. The rocker armature 5 is made of an electrically conductive magnetic material, such as but not limited to soft steel plated with silver. The rocker armature 5 is formed from a rectangular piece of sheet metal, having a substantially uniform thickness. The sheet metal piece is bent in a midportion of the sheet metal piece to create first and second arms 12 and 13 that extend at a fixed angle with respect to each other from a common vertex 18 also created by the bending of the sheet metal piece. The arms 12 and 13 of the rocker armature 5 have first faces 14 and 15 that are engageable with the switch electrical conductors on the first surface of the sheet magnet coupler layer 4 and second faces 16 and 17 on the opposite side of the armature. The first faces 14 and 15 of the arms 12 and 13 are substantially planar with the fixed included angle between the first faces 14 and 15 of the arms, preferably, being between about 185° and about 195° and, more preferably, about 188°.

A stronger magnetic coupling occurs between the arms 12 and 13 of the rocker armature 5 and the sheet magnet coupler layer 4 when more of the magnetic material forming the arms of the rocker armature interacts with the magnetic field lines of the sheet magnet coupler layer. Accordingly, with their substantially planar faces 14 and 15, when an armature arm 12 or 13 is located on or adjacent the first surface of the sheet magnet coupler layer 4, one of the arms 12 or 13 is more strongly coupled to the sheet magnet coupler layer 4 by the magnetic attraction between the arms and the sheet magnet coupler layer.

As the switch 2 is shown in FIG. 1, the rocker armature 5 is in a first position. In this first position, the face 14 of the first arm 12 of the rocker armature 5 is on or adjacent the first surface of the sheet magnet coupler layer 4 and the first arm 12 is magnetically coupled to the first surface of the sheet magnet coupler layer 4, while the first face 15 of the second arm 13 of the rocker armature 5 is neither on nor adjacent the first surface of the sheet magnet coupler layer and the second arm 13 is not magnetically coupled to the first surface of the sheet magnet coupler layer 4. The second set of switch electrical conductors 10 are electrically connected or shorted by the armature in this first armature position. When an actuating force 23 is applied downwardly on the second face 17 of the second arm 13 of the rocker armature sufficient to overcome the magnetic attractive force coupling the first arm 12 of the rocker armature to the first surface of the sheet magnet coupler layer 4, the first arm 12 of the rocker armature breaks away from the first surface of the sheet magnet coupler layer 4 and the rocker armature 5 pivots about the common vertex 18 in a clockwise direction. When the first arm 12 breaks away from the first surface of the sheet magnet coupler layer 4, a tactile snap is felt as the face 15 of the second arm 13 abruptly comes to rest on or adjacent the first surface of the sheet magnet coupler layer 4 placing the rocker armature in a second position. In this second position, the second arm 13 of the rocker armature 5 is magnetically coupled to the first surface of the sheet magnet coupler layer 4 while the first face 14 of the first arm 12 of the rocker armature 5 is neither on nor adjacent the first surface of the sheet magnet coupler layer and the first arm 12 is not magnetically coupled to the first surface of the sheet magnet coupler layer 4. With the rocker armature in this second position, the first face 15 of the second arm 13 electrically connects or shorts the first set of switch electrical conductors 11. The rocker armature 5 may be returned to the first position by applying an actuating force to the second face 16 of the first arm 12. With respect to the magnetic rocker switch 2, the sets of spaced switch electrical conductors 10 and 11 may include various spaced electrical conductor arrangements. For example, each set of spaced switch electrical conductors 10 and 11 may include a common switch electrical conductor, located beneath and always in contact with the common vertex 18 of the rocker armature 5, and a second switch electrical conductor spaced outwardly from the common vertex 18 and located between the common vertex and the free end 8 or 9 of the armature arm 12 or 13 so that when the rocker armature 5 is in the first position, the armature electrically connects the electrical conductor at the common vertex with one of the second switch electrical conductors and when the rocker armature 5 is in the second position, the armature electrically connects the electrical conductor at the common vertex 18 with the other second switch electrical conductor.

Figure 2:
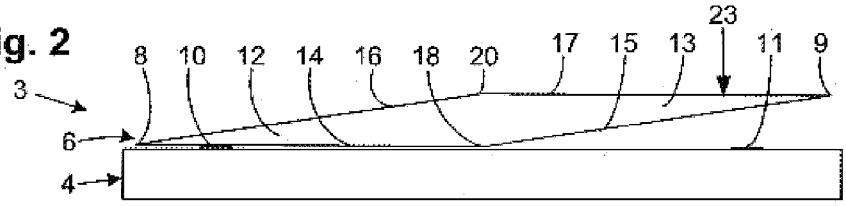
FIG. 2 is a side elevation view of a two-position magnetic rocker switch having a machined metal rocker armature according to the present invention.

FIG. 2 shows another rocker armature 6 that may be used in the two-position magnetic rocker switch of the present invention. The rocker armature 6 has first and second arms 12 and 13 that are tapered in thickness from the common vertex 18 of the armature to free ends 8 and 9 of the first and second arms 12 and 13. While the rocker armature 6 could be hollow, for better coupling of the arms 12 and 13 to the first surface of the sheet magnet coupler layer 4, the rocker armature 6 is a solid piece of electrically conductive magnetic material and the first faces 14 and 15 of the rocker armature arms 12 and 13 are substantially planar. In addition to the first armature faces 14 and 15 that are engageable with the switch electrical conductors on the first surface of the sheet magnet coupler layer 4, the arms 12 and 13 have second faces 16 and 17, on the opposite side of the armature, which are substantially planar. The first faces 14 and 15 of the arms 12 and 13 extend at a fixed angle with respect to each other with the fixed included angle between the first faces 14 and 15 of the arms, preferably, being between about 185° and about 195° and, more preferably, about 188°. The sheet magnet coupler layer 4 of the magnetic rocker switch 3 is the same as the sheet magnet coupler layer of the magnetic rocker switch 2 and the operation of the magnetic rocker switch 3 is substantially the same as the operation of the magnetic rocker switch 2 discussed above. The second faces 16 and 17 of the rocker armature 6 extend from an apex 20 located above the common vertex 18. The apex 20 between the faces 16 and 17 provides a physical barrier for controlling selective illumination of the faces 16 and 17 of the armature arms 12 and 13 in certain embodiments of the invention.

Figure 3:
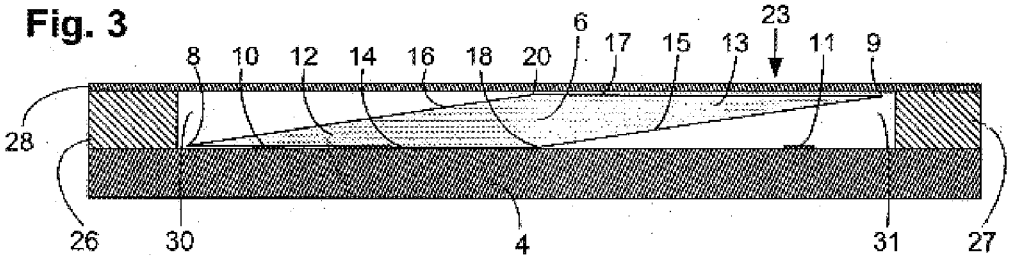
FIG. 3 is a cross sectional view of a two position rocker switch with illuminated armature faces according to the present invention.
Figure 4:
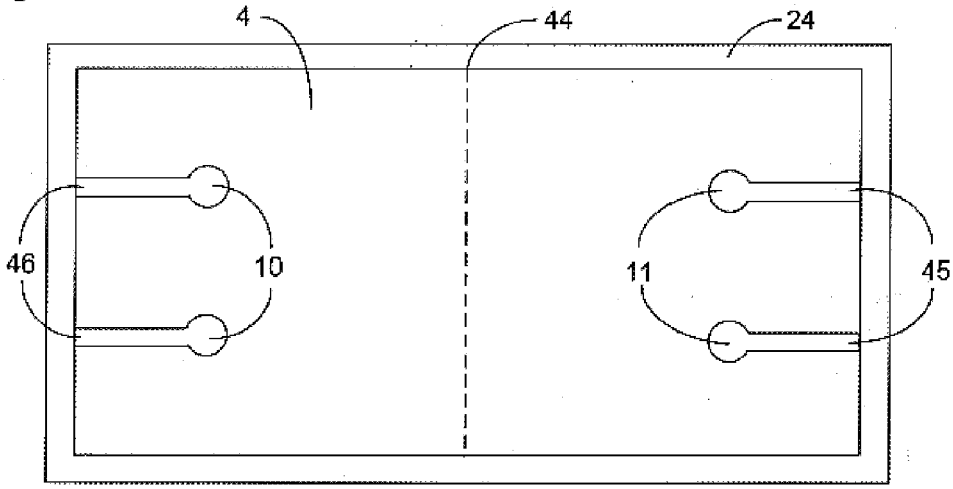
FIG. 4 is a plan view of the switch of FIG. 3 with the armature removed.

FIG. 3 shows the two-position magnetic rocker switch 3 of FIG. 2 with the rocker armature 6 of the switch housed within an opening in a spacer layer in the switch. The spacer layer is located intermediate the first surface of the sheet magnet coupler layer 4 and a transparent or translucent flexible membrane overlay 28, e.g. a polyester flexible membrane overlay, that overlays and seals the opening in the spacer layer. The flexible membrane overlay is adhesively bonded or otherwise secured to an upper surface of the spacer layer. The pivotal rocker armature 6 is contained within the opening in the spacer layer, where the rocker armature is magnetically coupled to the first surface of the sheet magnet coupler layer 4. As best shown in FIG. 4, the sheet magnet coupler layer 4 has screen printed leads 45 and 46 for connecting the sets of electrical conductors 10 and 11 to external electronics; a spacer layer adhered to and laying on top of the sheet magnet coupler layer 4 and leads 45 and 46; and a transverse centerline 44 where the common vertex 18 of the rocker armature 6 rests.

The spacer layer of the two-position magnetic rocker switch of FIG. 3 is typically electrically nonconductive and includes a lighting means such as light pipes 26 and 27. The spacer layer is of substantially uniform thickness, typically comprised of high-density foam and optional light pipes, and serves to maintain the opening that receives the armature. The term "spacer layer" refers to the spacer layer foam and/or any light pipes included in the switch. The spacer layer foam is usually cut to accommodate the light pipes. The light pipes 26 and 27 direct beams of light into cavities 30 and 31 formed within the opening in the spacer layer. The cavity 30 is defined by that portion of the opening in the spacer layer intermediate the common vertex 18 and the apex 20 of the rocker armature 6 and a first end of the opening. The cavity 31 is defined by that portion of the opening in the spacer layer intermediate the common vertex 18 and the apex 20 of the rocker armature 6 and a second end of the opening. When the rocker armature 6 is in the first position, as shown in FIG. 3, the light pipe 26 illuminates the second face 16 of the first arm 12 and that portion of the cavity 30 and the flexible membrane overlay 28 above the second face 16 of the first arm 12 to indicate that the rocker armature 6 is in the first position. Due to its location, the apex 20 of the rocker armature 6 functions as a physical barrier to prevent illumination by the light pipe 26 of the second face 17 of the second arm 13. With the rocker armature in the first position, the light pipe 27 illuminates the first face 15 of the second arm 13 and that portion of the cavity 31 intermediate the first face 15 of the second arm 13 and the first surface of the sheet magnet coupler layer 4. However, the second arm 13 functions as a physical barrier to prevent illumination by the light pipe 27 of the second face 17 of the second arm and that portion of the flexible membrane overlay 28 above the second face 17 of the second arm. When the rocker armature 6 is in the second position, the light pipe 27 illuminates the second face 17 of the second arm 13 and that portion of the cavity 31 and the flexible membrane overlay 28 above the second face 17 of the second arm 13 to indicate that the rocker armature 6 is in the second position. Due to its location, the apex 20 of the rocker armature 6 functions as a physical barrier to prevent illumination by the light pipe 27 of the second face 16 of the first arm 12. With the rocker armature 6 in the second position, the light pipe 26 illuminates the first face 14 of the first arm 12 and that portion of the cavity 30 intermediate the first face 14 of the first arm 12 and the first surface of the sheet magnet coupler layer 4. However, the first arm 12 functions as a physical barrier to prevent any illumination by the light pipe 26 of the second face 16 of the first arm and that portion of the flexible membrane overlay 28 above the second face 16 of the first arm.

The light pipes 26 and 27 may be colorless, e.g. merely illuminating the second faces 16 and 17 of the arms 12 and 13 or illuminating indicia on the second faces 16 and 17 of the arms 12 and 13, or the light pipes 26 and 27 may emit different color light beams. For example, the light pipe 26 could emit a green light and the light pipe 27 could emit a red light. When the rocker armature 6 of the switch is in the first position, the portion of the flexible membrane overlay above the second face 16 of the first arm 12 would be illuminated green. When the rocker armature 6 of the switch is in the second position, the portion of the flexible membrane overlay 28 above the second face 17 of the second arm 13 would be illuminated red. This form of illumination would be especially appropriate for a switch such as an on/off switch that only has one set of electrical conductors 10.

FIG. 4 is a top view of the switch of FIG. 3, but with the flexible membrane overlay 28 and the rocker armature 6 removed. The coupler magnet 4 has pairs of electrical contacts 10 and 11 screen-printed directly onto the surface of the coupler magnet. The screen print includes electrical leads 45 and 46 electrically connected to the electrical contacts 10 and 11. The electrical leads are connected to external electronics, not shown. There is an imaginary line shown at 44 that represents the pivotal point where the fulcrum 18 of the rocker armature 6 engages the first surface of the coupler magnet 4. The screen print design shown is just one possible design that will work well. Typically, the spacer layer is adhesively bonded to the coupler magnet 4, with screen-printed electrical leads 45 and 46 running between the coupler magnet and spacer layer. Alternatively, there could be a common electrical contact screen printed along imaginary line 44. A consideration before making a screen printed common electrical contact located along imaginary line 44 is possible wear or breakage of the common electrical contact where the fulcrum 18 of the rocker armature 6 engages the common electrical contact.

Figure 5:
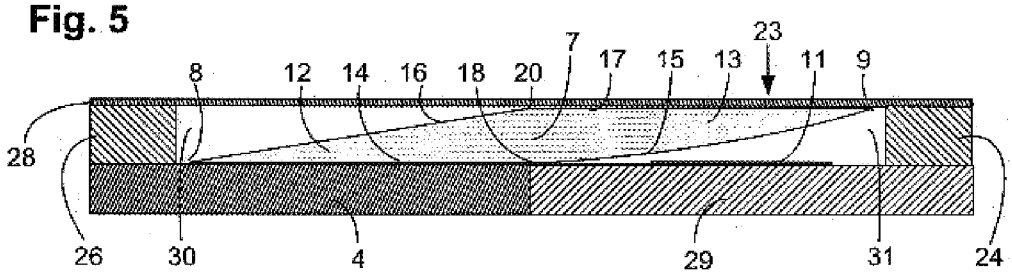
FIG. 5 is a cross sectional view of a momentary magnetic rocker switch with an illumined armature face according to the present invention.

FIG. 5 shows a momentary magnetic rocker switch with a pivoting rocker armature 7 of the switch housed within an opening in the spacer layer in the switch. Here the spacer layer is comprised of light pipe 26 and a spacer layer foam 24. The rocker armature 7 has first and second arms 12 and 13 that are tapered in thickness from the common vertex 18 of the armature to free ends 8 and 9 of the first and second arms 12 and 13. While the rocker armature 7 could be hollow, for better coupling of the arm 12 to the first surface of the sheet magnet coupler layer 4, the rocker armature 7 is a solid piece of electrically conductive magnetic material. As shown, the first and second faces 14 and 16 of the rocker armature arm 12 are substantially planar, the second face 17 of the second arm 13 of the rocker armature is substantially planar, and the first face 15 of the second arm 13 of the rocker armature has a curvature. A substrate layer of the momentary magnetic rocker switch is formed in part by the sheet magnet coupler layer 4 with no electrical conductors and in part by a nonconductive layer 29 with a set of electrical conductors 11. The substrate layer underlies the opening in the spacer layer, with the sheet magnet coupler layer 4 underlying about half of the opening and extending to the common vertex 18 of the pivoting rocker armature 7 housed within the opening to magnetically couple the rocker armature to the first surface of the sheet magnet coupler layer 4. The nonconductive layer 29 underlies the remainder of the opening in the spacer layer. The nonconductive layer 29 and the sheet magnet coupler layer 4 seal the underside of the opening in the spacer layer. The spacer layer is located intermediate the first surface of the substrate layer and a flexible transparent or translucent membrane overlay 28, e.g. a polyester film overlay, that overlays and seals the opening in the spacer layer; is adhesively bonded or otherwise secured to an upper surface of the spacer layer; and contains the pivoting rocker armature 7 within the opening in the spacer layer where the rocker armature is magnetically coupled to the first surface of the sheet magnet coupler layer 4.

Since the sheet magnet coupler layer 4 is only located beneath the first arm 12 of the rocker armature 7, the rocker armature 7 will only be stable in the first position, where the first arm is magnetically coupled to the first surface of the sheet magnet coupler layer 4. When an actuating force 23 is applied to the second face 17 of the second arm 13, the actuating force causes the rocker armature to pivot about the common vertex 18 of the armature into the second position. However, with no sheet magnet coupler layer beneath the second arm 13 to hold the armature in the second position, as soon as the actuating force 23 is removed from the second face 17 of the second arm 13 of the rocker armature, the magnetic attraction between the sheet magnet coupler layer 4 and the arm 12 of the rocker armature 7 causes the rocker armature to return to the first position where it is once again held in place by being magnetically coupled to the sheet magnet coupler layer 4.

Although any of the rocker armatures described herein will work well as the rocker armature of the momentary magnetic rocker switch of FIG. 5, the rocker armature 7 of FIG. 5 is especially well suited for the application. The first face 15 of the second arm 13 of the rocker armature 7 is slightly curved from adjacent the common vertex 18 of the rocker armature 7 to the free end 9 of the second arm 13. The curvature of the first face 15 of the second arm 13 eliminates tease. Tease is a condition that exists after a first arm of a rocker armature breaks away from a magnetic coupler and before a second arm of the rocker armature makes contact in a second position with a set of switch electrical conductors on a substrate layer. With the curvature of the first face 15 of the second arm 13, the first face 15 of the second arm 13 provides an extended contact area for contacting the set of switch electrical conductors 11 on the nonconductive layer 29. The curved face 15 rolls into contact with the set of electrical conductors 11 almost immediately after the first arm 12 breaks away from the sheet magnet coupler layer 4 and continues to contact the set of electrical conductors 11 throughout the travel of the armature to the second position.

The spacer layer of the momentary magnetic rocker switch of FIG. 5 is typically electrically nonconductive and includes light pipe 26. A section of the spacer layer foam 24 has been removed to accommodate the light pipe 26. The light pipe directs beams of light into cavity 30 formed within the opening in the spacer layer. The cavity 30 is defined by that portion of the opening in the spacer layer intermediate the common vertex 18 and the apex 20 of the rocker armature 7 and the first end of the opening. When the rocker armature 7 is in the first position, as shown in FIG. 5, the light pipe 26 illuminates the second face 16 of the first arm 12 and that portion of the cavity 30 and the flexible membrane overlay 28 above the second face 16 of the first arm 12 to indicate that the rocker armature 7 is in the first position. Due to its location, the apex 20 of the rocker armature 7 functions as a physical barrier to prevent any illumination by the light pipe 26 of the second face 17 of the second arm 13. With the rocker armature 7 in the second position, the light pipe 26 illuminates the first face 14 of the first arm 12 and that portion of the cavity 30 intermediate the first face 14 of the first arm 12 and the first surface of the sheet magnet coupler layer 4. However, the first arm 12 functions as a physical barrier to prevent any illumination by the light pipe 26 of the second face 16 of the first arm and that portion of the flexible membrane overlay 28 above the second face 16 of the first arm.

Figure 6:
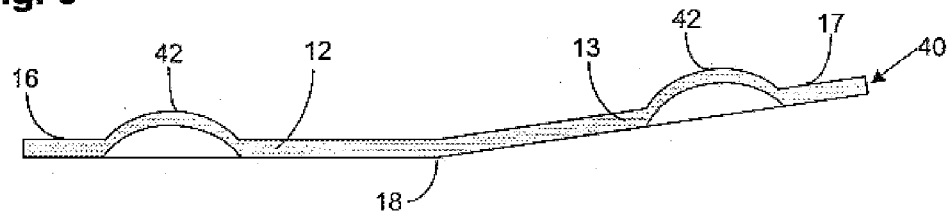
FIG. 6 is a cross sectional view of a sheet metal rocker armature according to the present invention with the addition of actuating buttons.
Figure 7:
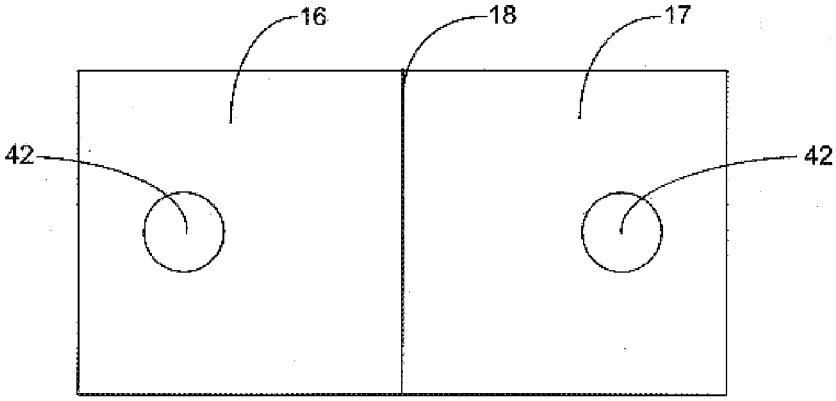
FIG. 7 is a plan view of the sheet metal rocker armature of FIG. 6.

FIGS. 6 and 7 show a sheet metal rocker armature 40 of the present invention. Except for the actuating buttons 42 projecting from the faces 16 and 17 of the arms 12 and 13, the sheet metal rocker armature 40 is the same as the sheet metal rocker armature 5 of FIG. 1. The actuating buttons 42 are added to provide more consistent tactile feedback to the user. The user-perceived magnitude of the actuating force will be much more consistent if directed toward the portion of the armature intended to receive the actuating force, where the actuating buttons are located. As the actuating buttons are located closer to the fulcrum, the user-perceived magnitude of the actuating force will increase.

Figure 8:
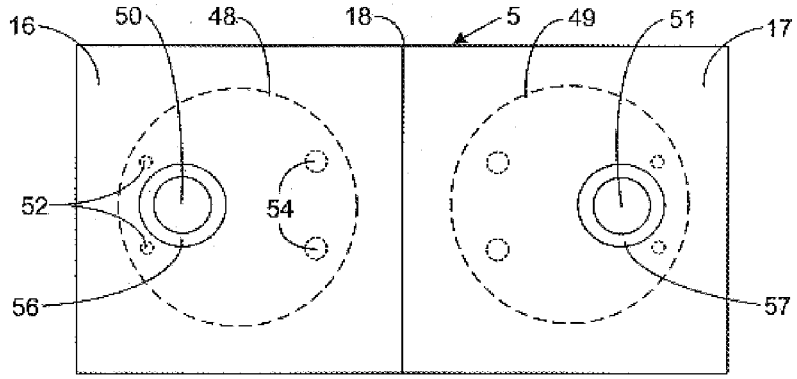
FIG. 8 is a plan view of a magnetic rocker switch with a sheet metal rocker armature, similar to the sheet metal rocker armature of FIG. 1, plus magnetic pushbutton switches.
Figure 9:
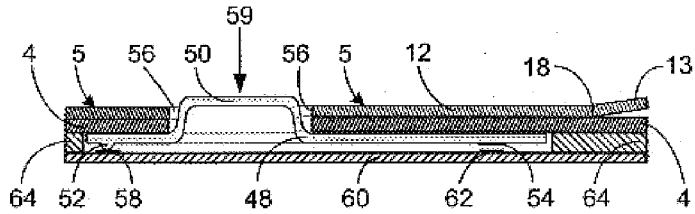
FIG. 9 is a cross sectional view of the left side of the switch of FIG. 8.

FIGS. 8 and 9 show a combination two-position magnetic rocker switch and magnetic pushbutton switch. The rocker armature 5 and coupler magnet 4 of FIG. 1 have the addition of apertures 56 and 57. The coupler magnet 4 magnetically attracts the rocker armature 5 and holds it against the first surface of the coupler magnet 4. A second surface of the coupler magnet, located opposite the first surface of the coupler magnet, magnetically attracts and holds pushbutton armatures 48 and 49. The pushbutton armatures 48 and 49 are electrically conductive and have crowns 50 and 51 that protrude through the apertures 56 and 57.

FIG. 9 shows the left side of the rocker armature 5 held in the first position. In this first position a user may apply a second actuating force 59 to the crown 50 of the pushbutton armature 48. The second actuating force 59 causes the pushbutton armature 48 to break away from the second surface of the coupler magnet 4. The pushbutton armature 48 has feet 52 that contact electrical contacts 58 formed, e.g. by screen printing or etching, on the first surface of a substrate layer 60. The substrate layer 60 is a nonconductive layer, e.g. a layer of printed circuit board material or plastic film such as polyester, separated from the sheet magnet coupler layer 4 by a pushbutton spacer layer 64. The pushbutton spacer layer 64 material may be 3M VHB foam with an adhesive that bonds to the second surface of the sheet magnet coupler layer 4 and to the first surface of the substrate layer 60. The second actuating force 59 initially causes the feet 52 of the pushbutton armature 48 to meet electrical contacts 58, and then the second actuating force 59 causes bumps 54 on the pushbutton armature 48 to meet electrical contacts 62 also formed, e.g. by screen printing or etching, on the first surface of the substrate layer 60. The conductive pushbutton armature 48 electrically connects electrical contacts 58 and 62 to electrically close a circuit. When the second actuating force is removed, the pushbutton armature is magnetically attracted to and coupled with the coupler magnet 4. The pushbutton armature 48 may only be actuated when the rocker armature 5 is in the first position. If the rocker armature 5 is moved to the second position, the crown 50 of the pushbutton armature 48 does not sufficiently protrude through the aperture 56, thereby preventing the user from applying the second actuating force 59 to the pushbutton armature until he first applies an actuating force to arm 12 of the rocker armature 5 such that rocker armature 5 is returned to the first position. With the rocker armature 5 held in the second position, the pushbutton armature 49 functions in the same manner as the pushbutton armature 48 when the rocker armature is in the first position.

Figure 10:
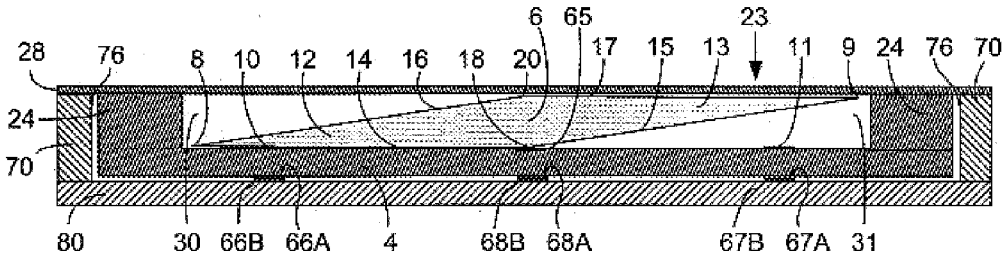
FIG. 10 is a cross sectional view of a rocker switch assembled as an Island switch.
Figure 11:
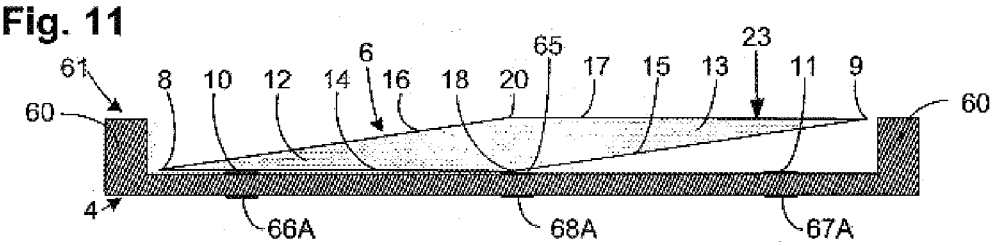
FIG. 11 is a cross sectional view of a magnetic rocker switch designed for use as an Island switch.
Figure 12:
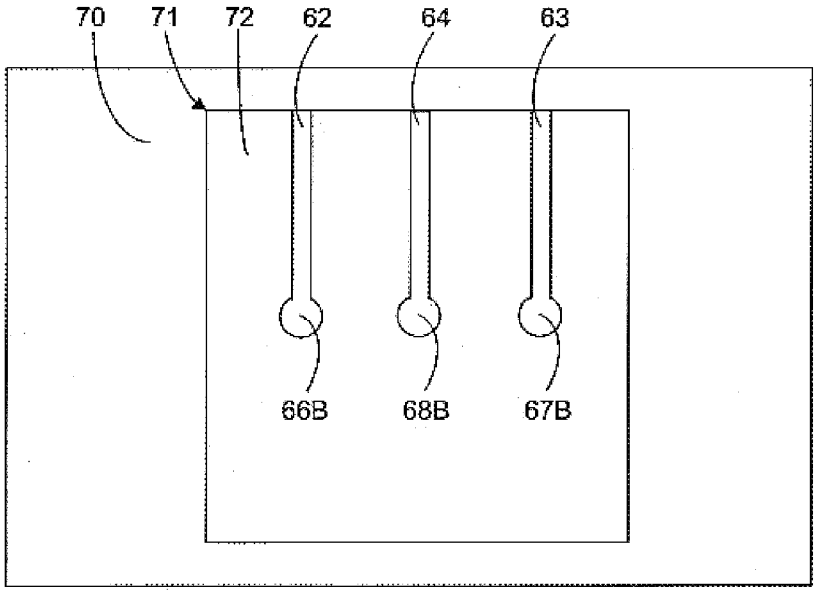
FIG. 12 is a plan view of a socket platform that accepts an Island rocker switch.
Figure 13:
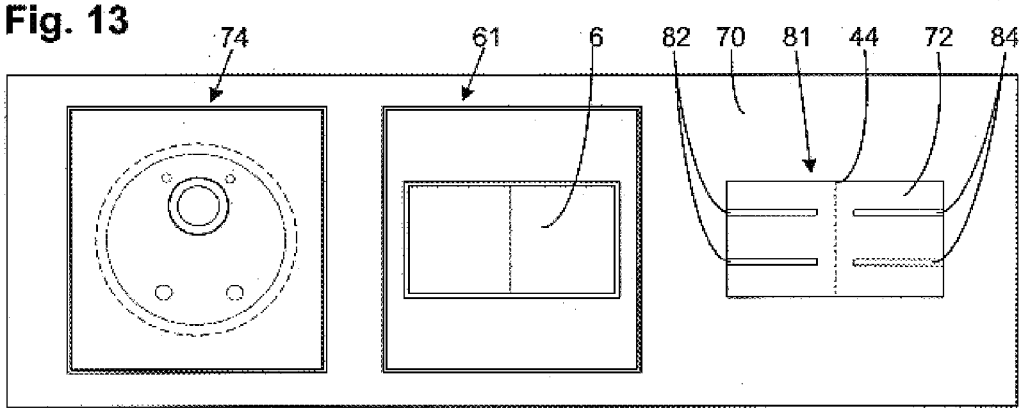
FIG. 13 is a plan view of a partially constructed Island without the flexible membrane overlay.

FIGS. 10–13 illustrate a rocker switch of the present invention adapted for use with an Island switch panel. U.S. Pat. No. 6,262,646 shows and describes pushbutton Island switches and rotor Island switches that may be incorporated on the same switch panel as the rocker Island switches of the present invention. FIG. 10 shows a cross sectional view of a fully assembled rocker Island switch. The rocker Island switch includes an actuator subassembly, a switch panel, and a flexible membrane overlay. FIG. 11 shows an actuator subassembly that is an individual module pre-assembled as a standalone part. FIG. 12 shows a switch panel having a large spacer layer, or panel layer 70, fixed to a panel substrate 72. The panel layer has an opening that defines a subassembly socket 71 that receives an actuator subassembly. The fully assembled FIG. 10 shows the flexible membrane overlay 28 that covers the actuator subassembly and the switch panel. The flexible membrane overlay, or film layer, is made of an elastomeric material or a flexible plastic, and can be transparent or translucent. Suitable graphics may be printed on the flexible membrane overlay to instruct a user as to the location and function of an actuator subassembly. FIG. 13 shows a sample switch panel without the flexible membrane overlay, but that has an installed pushbutton Island actuator subassembly 74, a rocker Island actuator subassembly 61 in its socket, and an alternative embodiment of a rocker Island 81 before the armature is installed.

The rocker Island switch of FIGS. 10–12 is similar in function and appearance to the rocker switch of FIG. 3 described above. The coupler magnet 4, spacer layer, rocker armature 6, and optional light pipes are all part of the rocker Island actuator subassembly. The actuator subassembly drops into a socket 71, the socket walls 76 are created by cutting or punching out a shape from the panel layer 70 that is appropriate for receiving an actuator subassembly. A typical material used for the panel layer would be closed cell adhesive foam, e.g. 3M Corporation VHB Series foam. The bottom of the socket is defined by the panel substrate 72, which has panel electrical contacts 66B, 67B and 68B. The actuator subassembly has subassembly electrical contacts 66A, 67A and 68A that align with and electrically connect to the panel electrical contacts 66B, 67B and 68B, respectively. One corner of the actuator subassembly may be beveled, with the socket similarly shaped, to prevent faulty alignment of the electrical contacts. The subassembly contacts 66A, 67A and 68A are electrically connected to electrical contacts 10, 11 and 65, respectively. The subassembly electrical contacts may be electrically connected to electrical contacts 10, 11 and 65 via a lead strap that wraps around the coupler magnet, via conductive posts that run through the coupler magnet where the electrical contacts are located, or via screen printed conductors that pass through or wrap around the coupler magnet. When the flexible membrane overlay 28 is laid over the top of an installed actuator subassembly, the subassembly electrical contacts and the panel electrical contacts are firmly pressed against each other so they are electrically connected.

Figure 14:
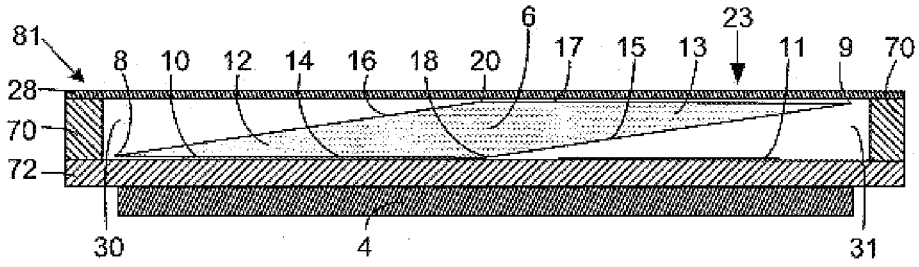
FIG. 14 is a cross sectional view of an assembled alternative construction of an Island rocker switch.

FIGS. 13 and 14 show the alternative embodiment of a rocker Island switch 81. The alternative embodiment of a rocker Island 81 includes an armature 6, switch panel with magnet, and flexible membrane overlay 28. The armature 6 functions as an individual module that drops into an armature socket. The armature socket is an opening in the panel layer 70 of the switch panel. The panel layer 70 is located intermediate the first surface of the panel substrate 72 and the flexible membrane overlay 28 that overlies and seals the armature socket. The flexible membrane overlay 28 is adhesively bonded or otherwise secured to an upper surface of the panel layer 70. The lower surface of the panel layer 70 is also adhesively bonded or otherwise secured to the upper surface of the panel substrate 72. The upper surface of the panel substrate 72 has etched or screen-printed electrical contacts 82 and 84 that are similar to the electrical contacts 10 and 11 of FIGS. 1 through 4. The fulcrum 18 of the rocker armature 6 rests along imaginary line 44. The rocker armature 6 is contained within the armature socket where the rocker armature is magnetically held against the panel substrate by a sheet magnet coupler layer 4 that is adhesively bonded or otherwise secured to the lower surface of the panel substrate 72.

Figure 15:
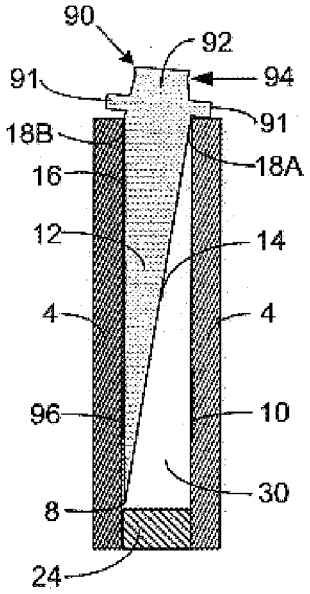
FIG. 15 is a cross sectional view of a two-position magnetic rocker switch having a toggle action and opposing magnets.

FIG. 15 illustrates a rocker switch of the present invention adapted to be a toggle switch. The toggle switch includes first and second magnetic coupler layers 4 that have opposed surfaces spaced from and extending generally parallel with respect to each other. The opposed surfaces of the magnetic coupler layers 4 have electrical conductors 10 and 96 thereon with electrical leads (not shown) for connecting the switch to external electronics. First ends of the first and second magnetic coupler layers 4 are joined by a non-conductive spacer layer foam 24, and a rocker armature 90 is pivotally mounted at its common vertexes 18A and 18B between the second ends of the first and second magnetic coupler layers. The first and second magnetic coupler layers 4, the non-conductive spacer layer and the common vertexes 18A and 18B of the rocker armature define a switch chamber 30. There are stops 91 on the armature to prevent it from dropping too deeply into the chamber 30. A suitable overlay, not shown, may cover that portion of the armature not housed in the chamber 30. The rocker armature 90 has its first arm 12 tapered in thickness from the common vertexes 18A and 18B of the armature to the free end 8. Alternatively, the armature could be of uniform thickness with the chamber gradually expanding to allow the free end of the armature to move from one coupler layer to the other coupler layer. The first arm 12 extends into the chamber 30 of the switch. In a first position the arm 12 is magnetically coupled to the first magnetic coupler layer 4 with the first face 14 of the arm 12 in shorting contact with the second set of electrical conductors 10. In a second position, as shown in FIG. 15, the arm 12 is magnetically coupled to the second magnetic coupler layer 4 with the second face 16 of the arm 12 in shorting contact with the first set of electrical conductors 96. When an actuating force, like the one at 94, is applied to either of the opposite surfaces of the second arm 92 of the rocker armature 90, the rocker armature 90 breaks away from the surface of the magnetic coupler layer upon which it is positioned and is moved and magnetically coupled to the surface of the other magnetic coupler layer. Of course, this movement of the rocker armature 90 moves the rocker armature out of shorting relationship with one set of electrical conductors (10 or 96) and into shorting relationship with the other set of electrical conductors (10 or 96).

Figure 16:
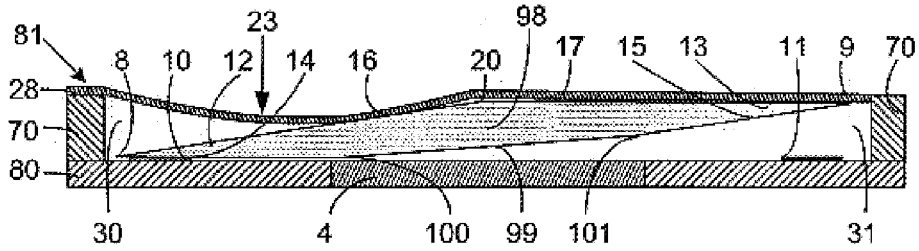
FIG. 16 is a cross sectional view of a three-position magnetic rocker switch having a normally off, center position.

FIG. 16 is a switch 81 according to the present invention that has two momentary on positions and a normally off position. The armature 98 is similar to the armature of FIG. 3 except there is a middle face 99 between the first faces 14 and 15. The middle face 99 is the only face of the armature that can be magnetically held by the coupler magnet 4; the coupler magnet has been shortened so it is only beneath the middle face. Additionally, there are two common vertexes, the first common vertex 100 is where the first face 14 of the first arm 12 meets the middle face 99, and the second common vertex 101 is where the first face 15 of the second arm 13 meets the middle face 99. When an actuating force 23 is applied to the second face 16 of the first arm 12, the armature 98 pivots about the first common vertex 100 as the armature breaks away from the coupler magnet 4. The first arm 12 then contacts electrical conductors 10 formed on a non-magnetic substrate layer 80. When the actuating force 23 is removed, the middle face 99 is magnetically attracted to and held by the coupler magnet 4 in an un-actuated position. An actuating force similar to actuating force 23 may then be applied to the second face 17 of the second arm 13 to move the first face 15 of the second arm 13 into contact with electrical conductors 11.

While a preferred form of the invention has been shown and described, it will be realized that alterations and modifications may be made thereto without departing from the scope of the following claims. The sheet magnet coupler layers used in the various embodiments of the present invention may be made from molded magnetic materials. These molded sheet magnet coupler layers may include peripheral flanges that function as spacer layers such as the flanges 60 of FIG. 11. The armature could be made of a ferromagnetic material. The armatures do not have to have a generally rectangular shape, and an armature may have arms of differing lengths. The common vertex could be formed on the magnet layer instead of the armature. Also, it will be understood that the term switch as used herein is intended to encompass devices of the type described whose electrical conductors are arranged either for on-off operation or for operation as a potentiometer.

What is claimed is:

1. An electrical switch, comprising:

a first sheet magnet coupler layer having first and second surfaces;

at least two electrical conductors defining a first set of switch electrical conductors;

an armature made of an electrically conductive magnetic material, the armature including first and second arms;

the first and second arms each having first faces that extend from a common vertex at a fixed angle with respect to each other; the first and second arms each having second faces; the first face of the first arm being substantially planar;

the armature being pivotally mounted to pivot about the common vertex between a first position and a second position, one of said positions electrically connecting the first set of switch electrical conductors;

the armature, when in the first position, being magnetically held in the first position with the first face of the first arm magnetically coupled to the first sheet magnet coupler layer; and a user provided actuating force, when applied to the second face of the second arm with the armature in the first position, causing the armature to pivot to the second position and the first face of the first arm to break away from the first surface of the first sheet magnet coupler layer.

2. The electrical switch according to claim 1, wherein:

the first and second arms are tapered in thickness from the common vertex to free ends of the first and second arms.

3. The electrical switch according to claim 2, including:

a lighting means for lighting the second face of the first arm when the armature is held in the first position.

4. The electrical switch according to claim 2, including:

a lighting means for lighting the second face of the second arm when the armature is in the second position.

5. The electrical switch according to claim 2, including:

a first lighting means for lighting the second face of the first arm when the armature is held in the first position; and a second lighting means for lighting the second face of the second arm when the armature is in the second position.

6. The electrical switch according to claim 1, wherein:

the first sheet magnet coupler layer is essentially electrically nonconductive and the at least two electrical conductors are formed directly on the first surface of the first sheet magnet coupler layer.

7. The electrical switch according to claim 1, wherein:

the at least two electrical conductors are formed on an electrically nonconductive carrier layer overlaying the first surface of the first sheet magnet coupler layer.

8. The electrical switch according to claim 1, wherein:

at least three electrical conductors are disposed on the first surface of the first sheet magnet coupler layer and define the first set of switch electrical conductors and a second set of switch electrical conductors;

the first face of the second arm is substantially planar;

the armature, when in the first position, is magnetically held in the first position with the first face of the first arm magnetically coupled to the first sheet magnet coupler layer in a shorting relationship with the second set of switch electrical conductors disposed on the first surface of the first sheet magnet coupler layer; and an actuating force applied to the second face of the second arm, when the armature is in the first position, causes the armature to pivot to the second position, the first face of the first arm to break away from the shorting relationship with the second set of switch electrical conductors disposed on the first surface of the first sheet magnet coupler layer, and the first face of the second arm to come into shorting relationship with the first set of switch electrical conductors disposed on the first surface of the first sheet magnet coupler layer.

9. The electrical switch according to claim 8, wherein:

the first and second arms are tapered in thickness from the common vertex to free ends of the first and second arms.

10. The electrical switch according to claim 9, including:

a lighting means for lighting the second face of the first arm when the armature is held in the first position.

11. The electrical switch according to claim 9, including:

a lighting means for lighting the second face of the second arm when the armature is held in the second position.

12. The electrical switch according to claim 9, including:

a first lighting means for lighting the second face of the first arm when the armature is held in the first position; and a second lighting means for lighting the second face of the second arm when the armature is held in the second position.

13. The electrical switch according to claim 8, wherein:

the first sheet magnet coupler layer is essentially electrically nonconductive and the at least three electrical conductors are formed directly on the first surface of the first sheet magnet coupler layer.

14. The electrical switch according to claim 8, wherein:

the at least three electrical conductors are formed on an electrically nonconductive carrier layer overlaying the first surface of the first sheet magnet coupler layer.

15. An electrical switch, comprising:

a sheet magnet coupler layer having first and second surfaces;

a flexible membrane layer;

a spacer layer with an opening therein intermediate the sheet magnet coupler layer and the flexible membrane layer; the flexible membrane layer overlaying the opening in the spacer layer;

at least two electrical conductors disposed on the first surface of the sheet magnet coupler layer and defining a first set of switch electrical conductors; the opening in the spacer layer overlaying the at least two electrical conductors disposed on the first surface of the sheet magnet coupler layer;

an armature made of an electrically conductive magnetic material, the armature including first and second arms; the armature being located within the opening in the spacer layer;

the first and second arms each having first faces that extend from a common vertex at a fixed angle with respect to each other; the first and second arms each having second faces; the first face of the first arm being substantially planar;

the armature being pivotally mounted to pivot about the common vertex between a first position and a second position, one of said positions electrically connecting the first set of switch electrical conductors;

the armature, when in the first position, being magnetically held in the first position with the first face of the first arm magnetically coupled to the sheet magnet coupler; and a user provided actuating force, when applied through the flexible membrane layer to the second face of the second arm with the armature in the first position, causing the armature to pivot to the second position and the first face of the first arm to break away from the first surface of the first sheet magnet coupler layer.

16. The electrical switch according to claim 15, wherein:

the first and second arms are tapered in thickness from the common vertex to free ends of the first and second arms.

17. The electrical switch according to claim 16, including:

a lighting means in the spacer layer for lighting only the second face of the first arm when the armature is held in the first position.

18. The electrical switch according to claim 16, including:

a lighting means in the spacer layer for lighting only the second face of the second arm when the armature is in the second position.

19. The electrical switch according to claim 16, including:

a first lighting means in the spacer layer for lighting only the second face of the first arm when the armature is held in the first position; and a second lighting means in the spacer layer for lighting only the second face of the second arm when the armature is in the second position.

20. The electrical switch according to claim 15, wherein:

the sheet magnet coupler layer is essentially electrically nonconductive and the at least two electrical conductors are formed directly on the first surface of the sheet magnet coupler layer.

21. The electrical switch according to claim 15, wherein:

the at least two electrical conductors are formed on an electrically nonconductive carrier layer overlaying the first surface of the sheet magnet coupler layer.

22. The electrical switch according to claim 15, wherein:

at least three electrical conductors are disposed on the first surface of the sheet magnet coupler layer defining the first set of switch electrical conductors and a second set of switch electrical conductors;

the first face of the second arm is substantially planar;

the armature, when in the second position, is magnetically held in the second position with the first face of the second arm magnetically coupled to the sheet magnet coupler layer in a shorting relationship with the first set of switch electrical conductors disposed on the first surface of the sheet magnet coupler layer; and an actuating force applied through the flexible membrane layer to the second face of the first arm, when the armature is in the second position, causes the armature to pivot to the first position, the first face of the second arm to break away from the shorting relationship with the first set of switch electrical conductors disposed on the first surface of the sheet magnet coupler layer, and the first face of the first arm to come back into the shorting relationship with a second set of switch electrical conductors disposed on the first surface of the sheet magnet coupler layer.

23. The electrical switch according to claim 22, wherein:

the first and second arms are tapered in thickness from the common vertex to free ends of the first and second arms.

24. The electrical switch according to claim 23, including:

a lighting means in the spacer layer for lighting only the second face of the first arm when the armature is held in the first position.

25. The electrical switch according to claim 23, including:

a lighting means in the spacer layer for lighting only the second face of the second arm when the armature is held in the second position.

26. The electrical switch according to claim 23, including:

a first lighting means in the spacer layer for lighting only the second face of the first arm when the armature is held in the first position; and a second lighting means in the spacer layer for lighting only the second face of the second arm when the armature is held in the second position.

27. The electrical switch according to claim 22, wherein:

the sheet magnet coupler layer is essentially electrically nonconductive and the at least three electrical conductors are formed directly on the first surface of the sheet magnet coupler layer.

28. The electrical switch according to claim 22, wherein:

the at least three electrical conductors are formed on an electrically nonconductive carrier layer overlaying the first surface of the sheet magnet coupler layer.

* * * * *